United States Patent [19]

Johnson

[11] Patent Number: 4,709,496

[45] **Date of Patent: * Dec. 1, 1987**

[54] SAFETY DEVICE INCLUDING CHAMBER PROBE

[76] Inventor: David A. Johnson, 3432 Tanglewood Way, Salem, Oreg. 97302

[ * ] Notice: The portion of the term of this patent subsequent to Oct. 28, 2003 has been disclaimed.

[21] Appl. No.: 943,946

[22] Filed: Dec. 18, 1986

[51] Int. Cl.[4] ..... F41C 17/08

[52] U.S. Cl. ..... 42/70.11; 42/1.05

[58] Field of Search ..... 42/70.11, 70.01, 1.05

[56] References Cited

U.S. PATENT DOCUMENTS 4,528,765 7/1985 Johnson ..... 42/70.11

4,619,062 10/1986 Johnson ..... 42/70.11

*Primary Examiner*—Charles T. Jordan

*Attorney, Agent, or Firm*—Chernoff, Vilhauer, McClung & Stenzel

[57] ABSTRACT

A safety device for use with a repeating firearm having a magazine well for holding a box-like removable magazine, to prevent the firearm from being fired unintentionally and for providing an indication visible at some distance that the firearm is in a safe condition. A main body of the device corresponds in size with the magazine for the weapon and includes a top portion which extends into the space left open between the breech and the face of the bolt of the weapon when the bolt is withdrawn. A plunger slidably disposed within the main body is connected with a movable chamber probe which would be prevented from entering the chamber by a round of ammunition, and which prevents the plunger from being moved to a position latching the device in the firearm unless the probe is able to enter the firing chamber. Visible exposure of more than a predetermined portion of the safety device indicates that the safety device is not properly installed in the weapon and that the weapon is therefore not to be considered safe.

19 Claims, 8 Drawing Figures

SAFETY DEVICE INCLUDING CHAMBER PROBE

BACKGROUND OF THE INVENTION

The present invention relates to firearms, and particularly to a safety device for use in connection with repeating firearms utilizing box-like removable magazines.

Many repeating firearms utilize replaceable magazines which, when in place in such a firearm, exclude dust, sand, and the like from entering internal mechanisms and doing damage or causing failure of the firearm to operate properly. When the replaceable magazine is not in place in such a weapon, however, the loading mechanism and other movable parts of the weapon are exposed to contamination by material carried by the air or otherwise found in the immediate environment.

Some firearms, particularly automatic firearms such as the self-loading M-16 rifle used by the Armed Forces of the United States, have ejection ports through which empty cartridge cases are ejected upon firing of the weapon. Although the empty case ejection port in many self-loading weapons is another potential point of entry for contaminants into the working mechanisms of the weapon, the M-16 rifle is equipped with a hinge-mounted cover which may be closed to protect the internal mechanisms of the rifle against such contamination. Thus, the M-16 and similar rifles, when a magazine is in place and the ejection port cover is closed, are relatively well-protected against contamination.

Safety is of prime importance in conducting military training exercises. For the sake of safety, however, soldiers have been permitted to carry an M-16 or similar rifle during some military training exercises only with the magazine removed, the ejection port cover open, and the bolt withdrawn rearwardly to an open position exposing the breech of the firing chamber, so that it could be clearly seen that the weapon was unloaded and not able to be fired, either accidentally or otherwise.

While use of the M-16 in such training exercises was thereby made safe, the working mechamisms of the rifle were exposed to possible contamination. Particularly when these requirements for the sake of safety were carried out during exercises performed in desert sand conditions, the weapons were exposed to entry of contaminating materials which caused a significant number of the weapons to malfunction in later use, unless internal working mechamisms of the weapons were carefully cleaned first. Such cleaning takes an undesirably long time to ready such basic infantry weapons for service use after their use in training exercises.

It is necessary to be able to carry out infantry training exercises safely, but without excessive risk of damage to weapons, and without requiring an unduly long period of time to make weapons ready for actual use thereafter.

Not only is it desirable for weapons to be in a safe condition during military training exercises, but it is also desirable that such a safe condition should be easily and quickly verifiable from a distance of at least several meters, so that it is quickly obvious to a commander if any of his men's weapons have not been properly made safe.

While a weapon may be made safe by removal of an essential part such as a firing pin, such a procedure has two problems. First, it may be difficult to verify that the procedure has been actually carried out and that the weapon is no longer capable of being fired. Second, there is a risk that a part which has been removed from its proper location might be lost or damaged so that it would be difficult or impossible to restore the weapon to its normal useful condition.

Johnson U.S. Pat. No. 4,528,765 discloses an externally visible safety device which effectively meets the need stated above, except that it does not preclude the somewhat remote possibility that a cartridge might be located within the firing chamber of the weapon, ready to be discharged immediately, should the safety device be removed. What is needed then, is a device which will positively prevent a weapon, particularly an automatic-loading weapon such as a military rifle, from being fired accidentally, or from even having a round of ammunition located in its chamber, and which will make it easily verifiable visually, from a considerable distance away from the weapon, that the weapon is incapable of being fired, and that the weapon does not contain any ammunition. Such a device ideally should be straightforward, inexpensive, and easy to use, should allow the weapon to be made safe without thereby exposing internal working parts to contamination, and should leave the weapon able to be made reliably ready for firing quickly and without disassembly or cleaning thereof.

SUMMARY OF THE INVENTION

The present invention provides an improvement over the prior art devices and meets the need for a reliable device for making automatic-loading rifles and the like safe for non-firing use during military training exercises, by providing a positively acting, easily visible safety device which can be installed through the magazine well of an automatic-loading weapon, but only when the chamber is clear of cartridges. When installed, the safety device is retained in the magazine well in place of the normal magazine by the latch which normally is used to secure a magazine, and prevents firing, while excluding dirt from the internal mechanisms of the weapon.

Because a portion of the safety device normally extends upwardly between the front of the breech bolt and the breech opening of the firing chamber, the main body of the safety device cannot be inserted fully into a weapon when the bolt is closed. When the safety device of the present invention is in place it prevents the release of a latch included in the weapon to hold the breech bolt of the weapon securely in its rearwardly located, open position. Additionally, inserting the device of the present invention into the weapon interposes a physical obstruction between the breech bolt and the breech opening of the firing chamber, thus preventing the bolt from moving forward to close the breech.

A movable chamber probe extends into the firing chamber of the weapon when the safety device is installed, as a precaution against the presence of any rounds of ammunition. Complete installation of the safety device into the magazine well, so that the magazine latch will retain the safety device, requires that the firing chamber be empty, since the latching portion of the safety device cannot be moved into mating engagement with the magazine latch mechanism of the weapon unless the movable chamber probe associated with the main body of the device is able to enter the chamber. The safety device will not remain in place only partially inserted into the weapon. Even when the main body is inserted fully into the weapon with its upper portion between the face of the breech bolt and the breech opening of the firing chamber, a large portion of the safety device is clearly visible extending outwardly beyond the opening of the magazine well, unless the chamber probe is extended into the chamber and the latch detent of the safety device is matingly engaged with the magazine latch mechanism of the weapon.

The safety device of the present invention includes flanges which rest against the outer edges of the magazine well into which the device is placed, to prevent entry of dust and grit into the magazine well when the safety device is installed and properly latched in place. Preferably, at least a portion of the safety device is made of a conspicuously brightly colored material, so that the flanges are clearly visible from some distance on either side of a weapon in which the safety device is installed.

With the safety device of the present invention properly latched into its fully inserted location in the magazine well it is clearly apparent that no cartridge is present in the firing chamber, and that the breech bolt is latched in its rearwardly withdrawn, open position. Therefore, the ejection port of a weapon such as the M-16 rifle used by the United States Armed Forces need not be left open to verify that the weapon has been made safe. Instead, the ejection port cover may be closed to protect the working mechanisms of the weapon from contamination by airborne dirt.

It is therefore a principal object of the present invention to provide a positively acting safety device whose presence and proper installation can be visually verified quickly and positively.

It is another object of the present invention to provide a safety device for military weapons which protects the internal moving mechanisms of such weapons against entry of dirt or sand when there is no magazine installed in the magazine well.

It is a principal feature of the present invention that it includes a chamber probe linked with a plunger carrying the latch detent which holds the device in place, so that the plunger cannot be moved to a position permitting the safety device to be latched in place within the magazine well of the weapon unless the probe is in place within the firing chamber.

It is another important feature of the safety device of the present invention that it includes a conspicuous flange which remains outside the magazine well of an automatic-loading rifle in which the safety device of the present invention is used, in order to provide an indication, clearly visible from either side of the weapon, that the weapon is safe.

It is yet a further feature of the safety device of the present invention that it includes a top portion which prevents insertion of the main body of the safety device into a weapon unless the bolt of the weapon is first fully withdrawn from the breech of the firing chamber and remains in such an open position.

It is an important advantage of the safety device of the present invention that, when installed, it provides an additional factor of safety of the weapon by indicating that there is no cartridge in the firing chamber and that the breech bolt is withdrawn and latched in its open position.

The foregoing and other objectives, features, and advantages of the present invention will be more readily understood upon consideration of the following detailed description of the invention taken in conjunction with the accompanying drawings.

DETAILED DESCRIPTION OF THE INVENTION

Figure 1:
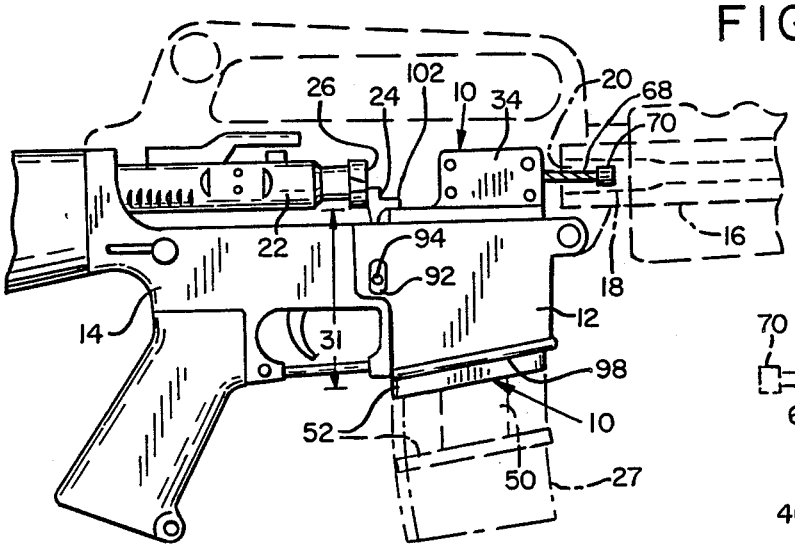
FIG. 1 is a right side elevational view, partially cut away, of part of an automatic rifle in which a safety device embodying the present invention is installed.
Figure 2:
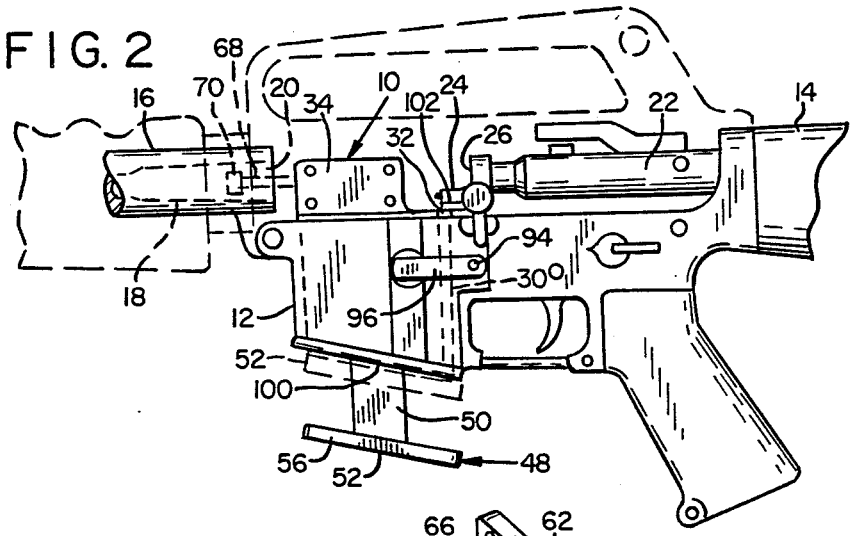
FIG. 2 is a left side elevational partial view of the automatic rifle shown in FIG. 1, showing the safety device of FIG. 1 partially installed.
Figure 3:
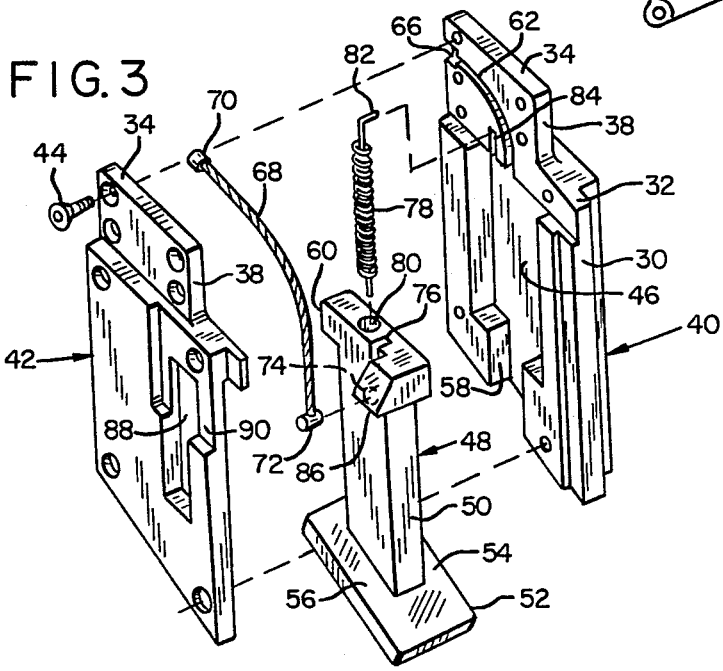
FIG. 3 is an exploded perspective view of the safety device shown in FIG. 1.
Figure 5:
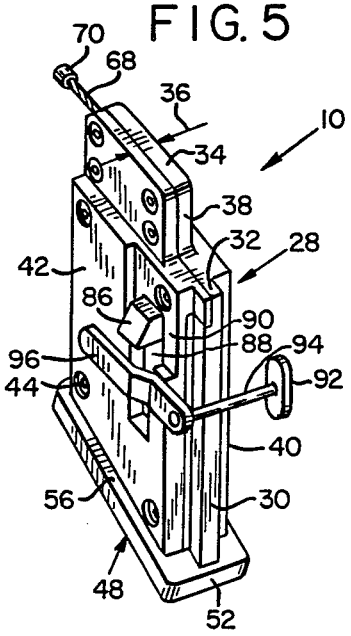
FIG. 5 is a perspective view, taken from the upper left rear, of the safety device shown in FIG. 1, showing the safety device as if it were properly installed within the rifle shown in FIG. 1.

Referring first to FIGS. 1–3 of the drawings, a safety device 10 embodying the present invention is shown in its operative position in the magazine well 12 of an automatic-loading rifle 14 similar to the model M-16 rifle used by the Armed Forces of the United States of America. For the sake of clarity, parts of the rifle 14 are shown in phantom lines in FIGS. 1 and 2. The rifle 14 includes a barrel 16 having a firing chamber 18 with a breech opening 20 located at the rear end of the barrel 16. A breech bolt 22 is reciprocatingly movable between a rearward, or open, position in which the bolt 22 is located as shown in FIGS. 1 and 2, and a forwardly-located, closed position in which the bolt 22 abuts against the rear end of the barrel 16, closing the breech opening 20. A bolt stop latch 24 is shown in FIG. 1 in a raised position, in which it is ahead of a portion of the front end 26 of the bolt 22, holding the bolt 22 in the open position.

A magazine 27, whose lower end is shown in broken line in FIG. 1, is normally held with its upper end within the magazine well 12 when the rifle 14 is loaded. Such a magazine 27 is removable to permit rapid reloading of the rifle 14 by replacement of an emptied magazine 27 with a fully loaded one. However, when no magazine 27 is present in the magazine well 12 the bolt 22 and other moving parts are exposed within the magazine well 12. Thus, when the magazine 27 is removed as a safety precaution, the internal parts of the action of the rifle 14 are susceptible to damage from abrasive dirt and open to entry of particles which could lodge in the action of the rifle 14, causing it to malfunction.

The safety device 10, shown in greater detail and at an enlarged scale in FIGS. 4–8, includes a generally rectangular main body 28. The exterior configuration of the main body 28 corresponds with the shape of the portion of a magazine 27 which fits within the magazine well. A rectangular spline 30 extends vertically along the rear side of the body and includes a surface or pad 32 at its upper end. The location of the pad 32 corresponds to that of a tab (not shown) connected to a cartridge follower of the magazine 27 when the rifle 14 is empty and the bolt 22 is open.

A top portion 34 having a width 36 narrower than the width of the main body 28 is located atop the main body 28 and extends above the height of the pad 32. The top portion 34 includes a generally vertical rear face 38.

The main body 28 includes a right side portion 40 and a left side, or cover, portion 42 which are ordinarily held together permanently, either by a plurality of fasteners such as nonremovable screws 44, or by adhesives, thermal welding, or other suitable manner of attachment which will not permit the cover portion 42 to be removed without significant difficulty. The right side portion 40 defines a cavity 46 within which a plunger 48 is disposed. The plunger includes an elongate body portion 50 and a base portion 52 which extends outwardly around the bottom end of the elongate body 50 of the plunger, defining a pair of flanges 54 and 56 on respective sides. In the safety device 10, designed for use particularly with an M-16 rifle, the flanges slope upwardly from the rear to the front of the main body 28, so that they tightly close the bottom of the magazine well 12. The flanges are thick enough (for example, being about 3/16 inch thick) to be clearly visible beneath the magazine well 12 when the safety device is in place, and to be used conveniently as a grip when removing the safety device 10 from the magazine well 12.

The right side portion 40 of the main body 28 defines a channel 58 within which the body 50 of the plunger 48 is slidably disposed, and a head 60 extends forwardly and rearwardly of the body 50 at its upper end, to prevent the plunger from being completely removed downwardly from within the cavity 46.

The main body 28 includes an arcuate passageway such as the connector slide channel 62 defined in the right side portion 40. The channel 62 may be U-shaped in profile, and extends upwardly above the cavity 46 and thence arcuately toward a front face 64 of the top portion 34, where a seat 66 is provided. The seat 66 is a generally cylindrical, forwardly-open cavity, of which a part may be defined by the left side portion 42 of the top section 34. Disposed within the connector slide channel 62 is a cable 68, which may be of twisted steel wire construction, or of other moderately flexible construction which is not significantly compressible longitudinally. A cylindrical tip 70 is swaged or cast onto a first end of the cable 68, extending concentrically and coaxially along the first end of the cable 68 from its extremity while a connector lug 72 is attached at the second end of the cable 68. The connector lug 72 may also be a cylindrical member, but is oriented transverse to the cable, so as to fit into a cylindrical socket 74 which extends transversely into a side of the plunger body 50. A groove 76 extends upwardly along the plunger body 50 to its end from the socket 74, in a position aligned with the connector slide channel 62, so that the cable 68 extends freely slidably into the lower end of the connector slide channel 62.

A long, slender helical compression spring 78 has a first end seated in a bore 80, while a guide rod 82 is disposed within the spring 78 and the bore 80. A bent over upper end of the guide rod 82 is seated in a short transverse bore at the upper end of a groove 84 defined in the right portion 40 of the main body 28. Thus the guide rod 82 remains stationary with respect to the right portion 40, while the spring 78 urges the plunger 50 outwardly from the cavity 46, to the extent permitted by the head 60.

Figure 4:
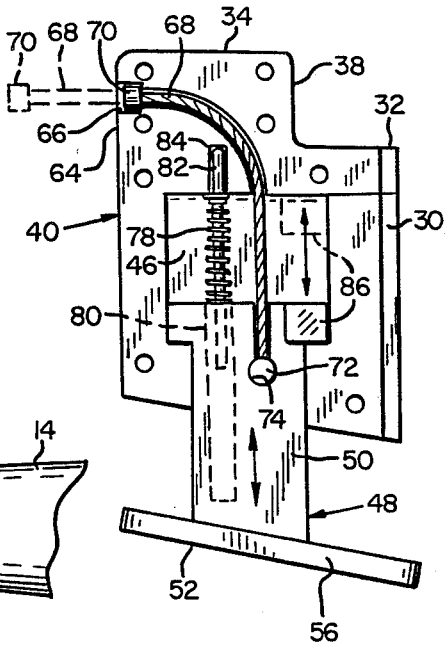
FIG. 4 is a left side elevational view of the safety device shown in FIG. 1, with a side cover portion thereof removed.

The length of the cable 68 is chosen so that when the plunger 50 is extended fully to a position in which the head 60 is located at the bottom of the cavity 46, with the connector lug 72 seated in its socket 74 and the cable 68 in the connector slide channel 62, the tip 70 is housed in the seat 66 defined in the front face 64 of the top portion 34 of the main body 28, as illustrated in FIG. 4.

A latch detent 86 extends leftward laterally from the rear end of the head 60 of the plunger 48 and protrudes laterally outward through a slot 88 defined in the left side, or cover portion 42. A depressed area 90 is provided in the outer face of the left or cover portion 42, surrounding the upper end of the slot 88, so that the outer end of the latch detent 86 extends outward a distance beyond the outer surface of the left cover portion 42 within the depressed area 90.

The main body 28 and spline 30 fit slidably within the magazine well portion 12 of the rifle 14, occupying the space which normally is occupied by the upper portion of the magazine 27 when the rifle 14 is loaded, and the size of the main body 28 approximates that of the interior of the magazine well 12. The width of the spline 30 and the distance to which the spline 30 extends rearwardly behind the rear side of the main body are determined by the interior dimensions of the magazine well 12, so as to provide a sliding fit for the spline 30 within a cartridge follower channel, provided in the rear portion of the magazine well 12 to allow movement of a tab of the cartridge follower (not shown) of the magazine 27. The spline 30 thus fills the cartridge follower channel to prevent entry of dirt when the safety device 10 is located operatively in the rifle 14. The magazine well 12 has an interior depth 31 (FIG. 1), the distance from its magazine-receiving opening to the location of the bolt 22 in the receiver portion of the rifle 14. The interior of the magazine well 12 similarly has an interior width extending laterally of the rifle 14, and an interior length, extending longitudinally of the rifle 14.

When the safety device 10 is operatively in use in a rifle 14, as shown in FIG. 1, it is retained within the magazine well 12 by the magazine latch mechanism of the rifle 14. The magazine latch mechanism includes a push button 92, located on the right side of the rifle 14, and a push rod 94 (shown in FIGS. 5, 7 and 8) which is biased toward the right side of the rifle by a latch spring (not shown). A catch 96 extends forward along the left side of the rifle 14, as shown in FIG. 2, and ordinarily engages a detent (not shown) located on the left side of a magazine such as the magazine 27, to hold the magazine in place within the magazine well 12.

The latch detent 86 has a sloping upper surface which is inclined downwardly and outwardly with respect to the left side of the safety device 10, as well as a generally horizontal bottom surface which extends horizontally outward from the left side of the safety device. Thus, as the plunger 48 of the safety device 10 is moved upwardly into the magazine well 12, the sloping surface of the latch detent 86, acting as a wedge, urges the magazine latch catch 96 leftward. Once the safety device 10 has been fully inserted into the magazine well 12, the catch 96 is free to move rightwardly, urged by the latch spring, into a latching position beneath the detent 86 and partially within the depression 90, retaining the safety device 10 within the magazine well 12, and retaining the plunger 48 in its inward position relative to the main body 28.

Figure 6:
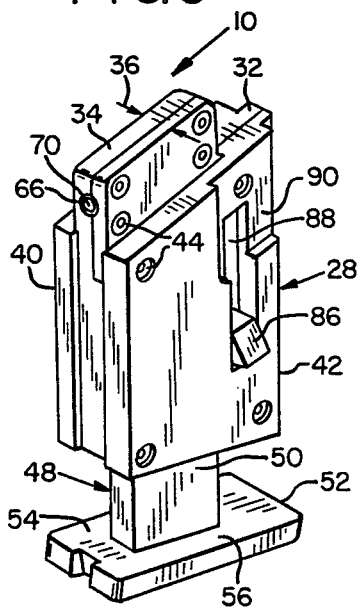
FIG. 6 is a perspective view, taken from the upper left front, of the safety device shown in FIG. 1 as it appears when it is not installed in a rifle.
Figure 7:
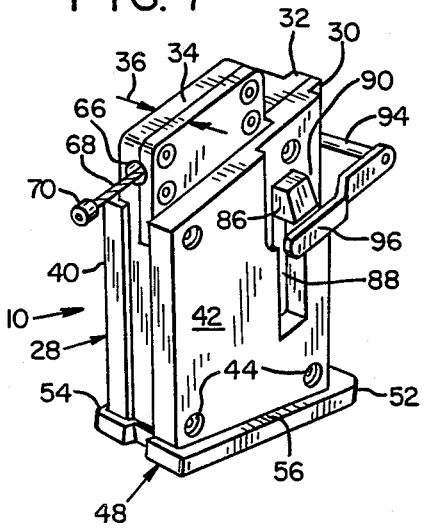
FIG. 7 is a view similar to FIG. 6, showing the condition of the safety device when it is properly installed in the magazine well of a weapon.
Figure 8:
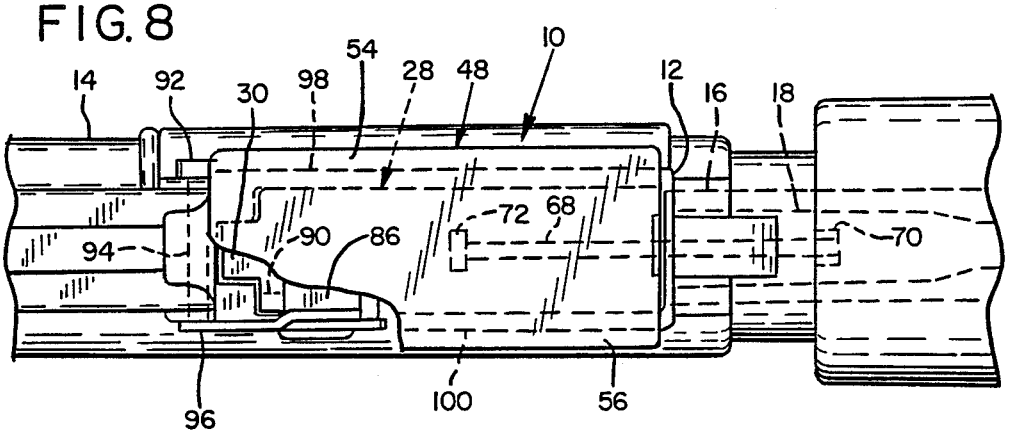
FIG. 8 is a bottom view of a portion of the rifle shown in FIG. 1, at an enlarged scale, with the safety device shown in FIG. 1 installed therein.

Ordinarily, when the safety device 10 is not installed within a weapon such as the rifle 14, the plunger 48 is extended, with the base 52 separated from the main body portion 28 of the safety device 10, exposing a portion of the body 50 of the plunger outside the main body 28. When the plunger 48 is thus extended from within the main body 28, the latch detent 86 is located in the bottom of the slot 88 as shown in FIG. 6. Since the cable 68 is connected to the plunger 48, it is withdrawn as a result of the extension of the plunger 48, so that the tip 70 is located within the socket 66, where the chamber probe does not interfere with installation or removal of the safety device 10.

For the safety device 10 to be inserted into its proper location the bolt 22 must first be withdrawn rearwardly to its open position in which it is held by the bolt latch 24 as shown in FIGS. 1 and 2. The safety device 10 is then inserted upwardly into the magazine well 12, with the top portion 34 extending upwardly beyond the magazine well 12 into the space between the front face 26 of the breech bolt 22 and the breech opening 20 of the chamber 18. In order for the magazine latch catch 96 to engage the latch detent 86, however, the plunger 48 must be urged upward beyond the position shown in solid line in FIG. 2 to the position shown in solid line in FIG. 1. The spring 78, however, ordinarily holds the plunger 48 extended from within the main body 28 until the main body 28 is fully inserted into the magazine well 12, placing the seat 66 in alignment with the breech opening 20. Further movement of the plunger 48 is still necessary at that point, however, in order for the latch detent 86 to engage the magazine latch catch 96. Because the cable 68 is connected with the plunger 48 by the connector lug 72, upward movement of the plunger 48 into the main body 28 causes the cable 68 to move through the connector slide channel 62, urging the tip 70 and the adjacent portion of the cable 68 to move forward from the seat 66 and extend beyond the forward face 64 of the main body 28 as a chamber probe. If there is anything located within the chamber 18, and particularly if there is a cartridge located within the chamber 18 in a position to be fired should the breech bolt 22 be closed, the tip 70 of the chamber probe portion of the cable 68 will be prevented from entering into the chamber 18, and, in turn, the plunger 48 will be prevented from being pushed into the cavity 46 far enough for the latch detent 86 to be held by the catch 96. As a result, unless the safety device 10 is continuously urged upwardly into the magazine well 12, the spring 78 will urge the plunger 48 outward with respect to the main body 28, retracting the cable 68 into the connector slide channel 62, leaving the front face 64 clear of any projections, and allowing the safety device 10 to fall from the magazine well 12.

Should the main body 28 be wedged or otherwise held within the magazine well 12, the position of the base 52 of the plunger 48, spaced apart from the magazine well 12, will provide a readily visible indication that the weapon may not be safe.

When the safety device 10 is held operatively within the magazine well 12 by the engagement of the magazine latch catch 96 and the latch detent 86, the flanges 54 and 56 abut closely against the bottom edges 98 and 100 of the left and right sides of the magazine well 12. Additionally, the front of the safety device 10 is then located closely adjacent to a front interior surface of the magazine well 12, the spline 30 fills the cartridge follower channel at the rear of the magazine well, and the rear of the safety device abuts against the rear interior surface of the magazine well 12, so that the safety device 10 effectively closes the magazine well 12 against entry of contaminants.

Furthermore, when the safety device 10 is in place the pad 32 is located against the bottom of a bolt stop latch lever 102 of the rifle 14. The bolt stop latch lever 102 is ordinarily raised to an operative position by a tab portion of the cartridge follower (not shown) of a magazine 27 upon rearward movement of the bolt 22 after ejection of the final cartridge which was originally located within a magazine 27. Once the latch lever 102 has been raised by the cartridge follower of a magazine, the bolt stop latch 24 remains in a raised position, preventing forward movement of the bolt 22 until it is manually released after a loaded magazine 27 has been inserted into the proper location within the magazine well 12.

Since the pad 32 of the safety device 10 is located at the position which would be taken by a portion of the cartridge follower of a magazine 27 upon ejection of the final cartridge, it holds the lever 102 up, preventing the bolt 22 from being released to move forward while the safety device 10 is latched within the magazine well 12. Nevertheless, should the bolt stop latch 24 or the lever 102 become broken, the rear face 38 of the top portion of the safety device 10 still prevents the bolt 22 from closing against the breech 20 of the barrel 16 and thus prevents the rifle 14 from discharging a cartridge, should such a cartridge be present in the chamber 18.

Some military rifles, such as the rifle 14, include an empty case ejection port cover which may be latched in an open position. Such an ejection port cover is typically attached to the right side of the rifle 14 by a hinge and is biased by a spring toward an open position, in which the ejection port cover closes the ejection port against entry of foreign material into the interior of the receiver of the rifle 14. It is usually difficult to determine visually, from any distance away from the rifle 14, whether the bolt 22 is closed or in a rearwardly-located open position, except by inspection with the ejection port cover open. Keeping the ejection port cover open, for the purpose of always being able to visually verify that the bolt is rearward, however, would permit precipitation or airborne foreign matter to contaminate the moving parts located within the receiver of the rifle 14. Thus, keeping the ejection port cover open increases the likelihood of the rifle 14 failing to operate properly at some later time.

As discussed previously, the safety device 10 cannot be fully inserted if the bolt 22 is closed when one attempts to insert the safety device 10. Since the magazine latch catch 96 engages the detent 86 only when the safety device 10 is fully inserted upwardly within the magazine well 12, with the plunger 48 pressed into the cavity 46 and the chamber probe tip 70 extended into the chamber 18 the safety device 10 will normally fall out of the magazine well 12. Therefore, the safety device 10 will either be absent or visibly protruding to an improperly greater extent if the rifle 14 is in a condition to be fired immediately.

On the other hand, if the safety device 10 is properly located within the magazine well 12 of the rifle 14, the flanges 54 and 56 will be adjacent the bottom edges 98 and 100 of the magazine well 12, clearly visible to a person on either side of the rifle 14. Since the safety device 10 can be inserted fully into the weapon only when the bolt 22 is fully rearwardly withdrawn to the open position as shown in FIGS. 1 and 2, the presence of the flanges 54 and 56 and closely along the bottom edges 98 and 100 verifies that the bolt 22 is fully rearwardly withdrawn, making it unnecessary for the ejection port cover to be kept open. Furthermore, the top portion 34 prevents a cartridge from being placed into the chamber 18 through the ejection port when the safety device 10 is in place.

Thus, the flanges 54 and 56 and the spline 30 close the bottom opening of the magazine well 12 to prevent entry of contaminating materials such as sand and the like, and the ejection port cover may be left closed to prevent entry of similar materials through the ejection port. Nevertheless, it is easy to verify visually, even from a considerable distance, that the rifle 14 has been made safe by the safety device 10 and cannot be fired unintentionally.

If it is desired, however, to fire the rifle 14 quickly, the safety device 10 can be quickly released from its location within the magazine well 12 by depressing the magazine latch release button 92 on the right side of the rifle 14. This permits the plunger 48 to extend from the main body 28, withdrawing the chamber probe 70 from the chamber 18. The safety device 10 is thus freed quickly to drop or be withdrawn from the magazine well 12, permitting a loaded magazine 27 to be inserted in the normal manner.

The main body 28 and the plunger 48 of the safety device 10 may be manufactured preferably of a durable high density plastics material with sufficient strength and thickness to prevent deformation which might permit dirt to enter the magazine well 12 around the safety device 10 and to prevent the bolt 22 from moving forward in case of failure of the bolt stop latch 24 to operate properly. The material should, preferably, be somewhat resilient in order to provide a snug sliding fit in the magazine well and avoid damage to the moving parts such as the bolt 22 which may come into contact with the safety device 10. Preferably, at least the base 52 of the plunger 48 of the safety device 10 has a bright, clearly visible color, such as international orange, which contrasts with the color of the rifle 14, in order to facilitate verification from a distance of at least several meters that the safety device 10 is properly located within a magazine well 12. The body portion 52 of the plunger 48 which is normally housed within the cavity of the main body 28 may be of a contrasting, easily visible color such as white, to be seen easily when the safety device 10 is located within the magazine well 12 but not fully seated and latched in position.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A safety device for use in a repeating firearm of the type having a chamber for holding a cartridge during firing, a bolt reciprocatingly movable between a closed position necessary for the firearm to be fired and an open position which prevents firing, and having a magazine well including an opening for receiving a magazine therein, the safety device comprising:

(a) a main body capable of fitting within said magazine well;

(b) movable chamber probe means associated with said main body for detecting the presence of an object in the chamber of said firearm; and (c) movable indicator means, associated with said main body and connected with said chamber probe means, for providing a visible indication when said chamber probe means encounters an object in said chamber.

2. The safety device of claim 1, wherein said indicator means includes a plunger member disposed slidably in said main body and connected with said chamber probe means so as to cause said plunger member to extend outward from said main body beyond a predetermined position when said main body is located within said magazine well, unless said chamber probe means is fully extended into said chamber of said firearm.

3. The safety device of claim 2, further including elastic biasing means for urging said plunger member visibly outward from said main body, and detent means for engaging a magazine latch of said firearm to hold said main body in said magazine well and said plunger member in said main body when said probe means is extended into said chamber.

4. The safety device of claim 2, including resilient biasing means for urging said plunger toward an outwardly extended position with respect to said main body.

5. The safety device of claim 4, further including detent means for engaging said firearm and holding said safety device with said main body located in said magazine well and said plunger in an inwardly located position indicating a safe condition of said firearm when said probe is extended into said chamber.

6. The safety device of claim 5 wherein said firearm includes a magazine latch, said detent means includes a detent located on said plunger in position to cooperate with said magazine latch of said firearm, said main body defining a cavity and said plunger being slidably disposed at least partially therein, and said biasing means including a spring located within said cavity and disposed between said plunger and said main body, urging said main body into said magazine well when said detent is in latching engagement with said magazine latch of said firearm.

7. The safety device of claim 2 wherein said plunger includes a base portion which fits closely adjacent the opening of said magazine well, closingly covering said magazine well when said chamber probe is fully extended when said main body is located properly within said magazine well.

8. The safety device of claim 1 wherein said plunger includes a base portion attached thereto which fits closely adjacent the opening of said magazine well, closingly covering said magazine well when said chamber probe is fully extended when said main body is located properly within said magazine well.

9. The safety device of claim 1 including means for holding said chamber probe means retracted toward said main body far enough not to cause interference between said safety device and said firearm during insertion of said safety device into said magazine well.

10. The safety device of claim 9 wherein said means for holding said chamber probe means retracted includes a spring disposed within said main body and acting upon said main body and said indicator means, urging said indicator means toward a position in which said indicator means retracts said chamber probe means into said main body.

11. The safety device of claim 9 including detent means associated with said indicator means, for engaging said firearm and holding said safety device in place within said magazine well when said chamber probe means is extended, and means interconnecting said chamber probe means with said indicator means, for preventing engagement of said detent means unless said chamber probe means is fully extended.

12. The safety device of claim 1 wherein said chamber probe means includes a metal cable connected with said movable indicator means, said cable including a first end which extends into said chamber when said chamber is unobstructed and said safety device is inserted properly into said magazine well.

13. The safety device of claim 12 including a tip member attached fixedly to said first end of said cable, said tip member having a diameter great enough to prevent said probe means from entering said chamber when a cartridge is located therein and to prevent said cable from being retracted into said main body beyond a predetermined location.

14. The safety device of claim 12 wherein said main body defines an arcuate passageway and said cable includes a second end connected with said indicator means, said cable extending through said arcuate passageway from said indicator means to said first end thereof.

15. The safety device of claim 1 wherein said main body includes top portion means for preventing said bolt from moving from the open position to the closed position when said main body is properly located within said magazine well, and for preventing said main body from being inserted fully into said magazine well when said bolt is in said closed position.

16. The safety device of claim 15 wherein said chamber probe means includes a metal cable connected with said movable indicator means, said cable including a first end which extends into said chamber when said chamber is unobstructed and said safety device is inserted properly into said magazine well.

17. The safety device of claim 16, including a tip member attached fixedly to said first end of said cable, said tip member having a diameter great enough to prevent said probe means from entering said chamber when a cartridge is located therein and to prevent said cable from being retracted into said main body beyond a predetermined location.

18. The safety device of claim 16 wherein said main body defines an arcuate passageway and said cable includes a second end connected with said indicator means, said cable extending through said arcuate passageway from said indicator means to said first end thereof.

19. The safety device of claim 1 including flexible connector means for connecting said movable chamber probe means with said indicator means.

* * * * *